US008146390B2

(12) United States Patent
Moon et al.

(10) Patent No.: US 8,146,390 B2
(45) Date of Patent: Apr. 3, 2012

(54) LAUNDRY TREATING APPARATUS

(75) Inventors: Jung Wook Moon, Changwon-si (KR); Chang Gyu Choi, Changwon-si (KR); Hye Yong Park, Changwon-si (KR); Seung Gyu Ryu, Changwon-si (KR); Kwang Hee Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 332 days.

(21) Appl. No.: 12/382,870

(22) Filed: Mar. 25, 2009

(65) Prior Publication Data

US 2010/0058813 A1 Mar. 11, 2010

(30) Foreign Application Priority Data

Mar. 26, 2008 (KR) ..... 10-2008-0027825

(51) Int. Cl.
*D06B 1/02* (2006.01)

(52) U.S. Cl. ..... 68/5 C; 68/213

(58) Field of Classification Search ..... 68/5, 5 D, 68/213, 213 C

See application file for complete search history.

(56) References Cited

U.S. PATENT DOCUMENTS

| | | | | | |
|---|---|---|---|---|---|
| 1,453,967 | A * | 5/1923 | Angelus | 68/7 |
| 2,075,724 | A * | 3/1937 | Jacobs | 223/51 |
| 2,245,554 | A * | 6/1941 | Court | 134/24 |
| 2,410,485 | A * | 11/1946 | Du Nah | 223/67 |
| 2,764,171 | A * | 9/1956 | Nolte | 134/145 |
| 3,121,536 | A * | 2/1964 | McKibben | 239/253 |
| 3,672,188 | A * | 6/1972 | Geschka et al. | 68/12.15 |
| 3,805,561 | A * | 4/1974 | Bullock | 68/5 C |
| 3,868,835 | A * | 3/1975 | Todd-Reeve | 68/20 |
| 4,098,566 | A * | 7/1978 | Zink et al. | 431/202 |
| 5,305,484 | A * | 4/1994 | Fitzpatrick et al. | 8/149.3 |
| 5,815,961 | A * | 10/1998 | Estes et al. | 38/14 |
| 6,425,192 | B2 * | 7/2002 | Arrieta et al. | 34/486 |
| 6,994,098 | B2 * | 2/2006 | Rosenbauer et al. | 134/25.2 |
| 7,235,109 | B2 * | 6/2007 | Kleker | 8/149.3 |
| 2003/0126691 | A1 * | 7/2003 | Gerlach et al. | 8/158 |
| 2004/0040586 | A1 * | 3/2004 | Kumar | 134/26 |
| 2004/0134237 | A1 * | 7/2004 | Sunshine et al. | 68/3 R |
| 2004/0146425 | A1 * | 7/2004 | Joshi | 422/5 |
| 2005/0115120 | A1 * | 6/2005 | Cevik | 38/14 |

(Continued)

FOREIGN PATENT DOCUMENTS

CN 1037557 11/1989

(Continued)

OTHER PUBLICATIONS

European Patent Office 1 671 572 Jun. 2000.*

*Primary Examiner* — Frankie L Stinson
(74) *Attorney, Agent, or Firm* — McKenna Long & Aldridge LLP

(57) ABSTRACT

The present invention relates to a laundry machine, and more particularly, to an apparatus for treating a laundry, by which a laundry can be treated in a manner of hanging the laundry or the like with a cabinet type body. The present invention includes a cabinet comprising an accommodating space and a mechanism compartment partitioned from the accommodating space by a partition, a steam generator configured to generate steam to be supplied to the accommodating space, and a steam supply unit configured to pass through the partition, the steam supply unit comprising a rotating nozzle to supply steam into the accommodating space.

16 Claims, 5 Drawing Sheets

U.S. PATENT DOCUMENTS

| | | | | |
|---|---|---|---|---|
| 2006/0179678 | A1 * | 8/2006 | Jonsson et al. | 34/195 |

FOREIGN PATENT DOCUMENTS

| | | | |
|---|---|---|---|
| CN | 1324964 | | 12/2001 |
| CN | 2587914 | | 11/2003 |
| CN | 101046055 | | 10/2007 |
| DE | 19929052 | | 11/2000 |
| DE | 100 38 406 | * | 1/2002 |
| GB | 1414041 | | 11/1975 |
| JP | 3075003 | | 3/1991 |
| WO | WO 97/47798 | | 12/1997 |
| WO | WO 2008/002047 | | 1/2008 |

* cited by examiner

LAUNDRY TREATING APPARATUS

This application claims the benefit of the Korean Patent Application No. 10-2008-0027825, filed on Mar. 26, 2008, which is hereby incorporated by reference as if fully set forth herein.

BACKGROUND OF THE INVENTION

1. Field of the Invention

The present invention relates to a laundry machine, and more particularly, to an apparatus for treating a laundry. Although the present invention is suitable for a wide scope of applications, it is particularly suitable for treating a laundry in a manner of hanging the laundry or the like with a cabinet type body.

2. Discussion of the Related Art

Generally, a laundry treating device means a device for washing or drying a laundry and the like. Specifically, there is a cabinet type laundry treating device that treats a laundry hung therein. This laundry transiting device is provided with a hot-air supplier for drying a laundry by supplying hot air to a space (hereinafter named 'accommodating space') for accommodating the laundry therein.

Meanwhile, the cabinet type laundry treating device can be provided with a steam generator for such a laundry refresh function as pleat-free, deodorization, electrostatic-free, sanitization and the like as well as the drying function. In particular, the cabinet type laundry treating device is able to perform the refresh function by supplying steam to the accommodating space.

Meanwhile, the steam needs to be evenly supplied to the accommodating space. If the steam is locally supplied to a specific part, it may happen that the laundry fails to be refreshed overall.

However, it is very difficult to evenly supply steam to the accommodating space. Since the steam is supplied via a nozzle or the like due to its property unlike hot air, it can be directly supplied to a laundry rather than spreads into surroundings. Thus, it is difficult to effectively supply the steam to a part away from a nozzle direction or a part distant from the nozzle.

Moreover, it may be difficult to assemble/disassemble the laundry treating device due to the nozzle. This is because the nozzle is provided to the accommodating space while the steam generator is located at a place isolated from the accommodating space.

Therefore, since it is difficult to form a path for connecting the nozzle and the steam generator, it may be difficult to assemble/disassemble the laundry treating device. This difficulty may raise a product cost and also fails to facilitate the repair of the product.

SUMMARY OF THE INVENTION

Accordingly, the present invention is directed to an apparatus for treating a laundry that substantially obviates one or more problems due to limitations and disadvantages of the related art.

An object of the present invention is to provide an apparatus for treating a laundry, by which a refresh function can be effectively performed by evenly supplying steam to the laundry accommodated in an accommodating space.

Another object of the present invention is to provide an apparatus for treating a laundry, by which a product cost is lowered in a manner of providing a simple configuration for generating to supply steam to an accommodating space to facilitate assembly and disassembly.

A further object of the present invention is to provide an apparatus for treating a laundry, by which an after-service is facilitated in a manner of providing a simple configuration for generating to supply steam to an accommodating space to facilitate assembly and disassembly.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine according to the present invention includes a cabinet including an accommodating space and a mechanism compartment partitioned from the accommodating space by a partition, a steam generator configured to generate steam to be supplied to the accommodating space, and a steam supply unit configured to pass through the partition, the steam supply unit including a rotating nozzle to supply steam into the accommodating space. In this case, the rotating nozzle is preferably provided to rotate under the accommodating space.

Preferably, the rotating nozzle includes a plurality of stream outlets.

Preferably, the rotating nozzle can include a plurality of sub-arms.

More preferably, each of the sub-arms includes a plurality of steam outlets.

In this case, at least one of the steam outlets is formed to have a tangential direction of the supplying steam direction to rotate the rotating nozzle. In particular, the rotating nozzle can be rotated by a pressure for supplying the steam without a separate rotational drive force (actuating force). Therefore, it is able to rotate the rotating nozzle while the steam is supplied.

Preferably, the sub-arms are formed upwardly slanted along with the radially extended direction. If the rotating nozzle is located at the center of a bottom of the accommodating space, it is necessary to gather the supplied steam to a central part. When the laundry is accommodated in the accommodating space, a laundry tends to be placed at the central part. Hence, it is highly possible that the steam provided to sides may not be supplied to the laundry.

Preferably, the steam supply unit includes a support shaft configured to support the rotating nozzle rotatably.

More preferably, the support shaft is formed as a hollow pipe.

In this case, the steam supply unit further includes a steam hose configured to form a steam path between the steam generator and the support shaft.

And, the steam hose is connected to the support shaft by being inserted into the support shaft. Moreover, the steam hose is formed as a flexible hose.

Besides, the steam hose can be configured to pass through the partition. In this case, the steam hose is configured to pass between a top of the mechanism compartment and the bottom of the accommodating space. Therefore, after the steam hose has been made to pass through, the steam hose and the support shaft are facilitated to be assembled together in the accommodating space. Likewise, the steam hose and the support shaft are facilitated to be disassembled from each other. Since the accommodating space is empty, no obstacles further facilitate the assembly/disassembly.

More preferably, the steam supply unit can further include a rotation pipe configured to rotate inside the support shaft as one body with the rotating nozzle. The rotation pipe is connected to an upper side within the support shaft and the steam hose is connected to a lower side within the support shaft. Therefore, the rotation shaft is rotated while the steam hose is not notated.

Meanwhile, according to another embodiment of the present invention, the support shaft can be configured to pass through the partition. In this case, the support shaft is configured to pass from the bottom of the accommodating space to the top of the mechanism compartment. Therefore, after the support shaft has been made to pass trough, it is facilitated to connect the steam hose and the support shaft together within the mechanism compartment.

In this case, the laundry machine can further include an actuating device configured to generate an actuating force to rotate the rotation pipe. And, the actuating device is installed in the mechanism compartment.

Preferably, the laundry machine according to the embodiments of the present invention further includes a main door for selectively opening or closing the accommodating space. Moreover, the laundry machine according to the embodiments of the present invention further includes a sub-door for selectively opening or closing the mechanism compartment when the main door is open. When the main door is normally open, the mechanism compartment is preferably closed for a fine view and safety.

In particular, a dual-door structure including the main door and the sub-door is provided to facilitate the assembly/disassembly of the steam generator and the steam supply unit.

More preferably, the main door is configured to be opened prior to opening the sub-door. While both of the main door and the sub-door are open, a user is able to secure a view and space with ease. Therefore, the user is facilitated to assemble/disassemble the steam supply unit configured to pass through the partition and the steam generator provided to the mechanism compartment.

Accordingly, the present invention provides the following effects and/or advantages.

First of all, the present invention evenly supplies steam to a laundry placed in an accommodating space, thereby performing a refresh function effectively.

Secondly, the present invention facilitates assembly and disassembly by simplifying a structure for generating to supply steam to an accommodating space, thereby reducing a product cost and facilitating an after-service.

Thirdly, the present invention provides a dual-door structure including a main door and a sub-door, thereby enhancing a fine view and safety and facilitating assembly/disassembly between a steam generator and a steam supply unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
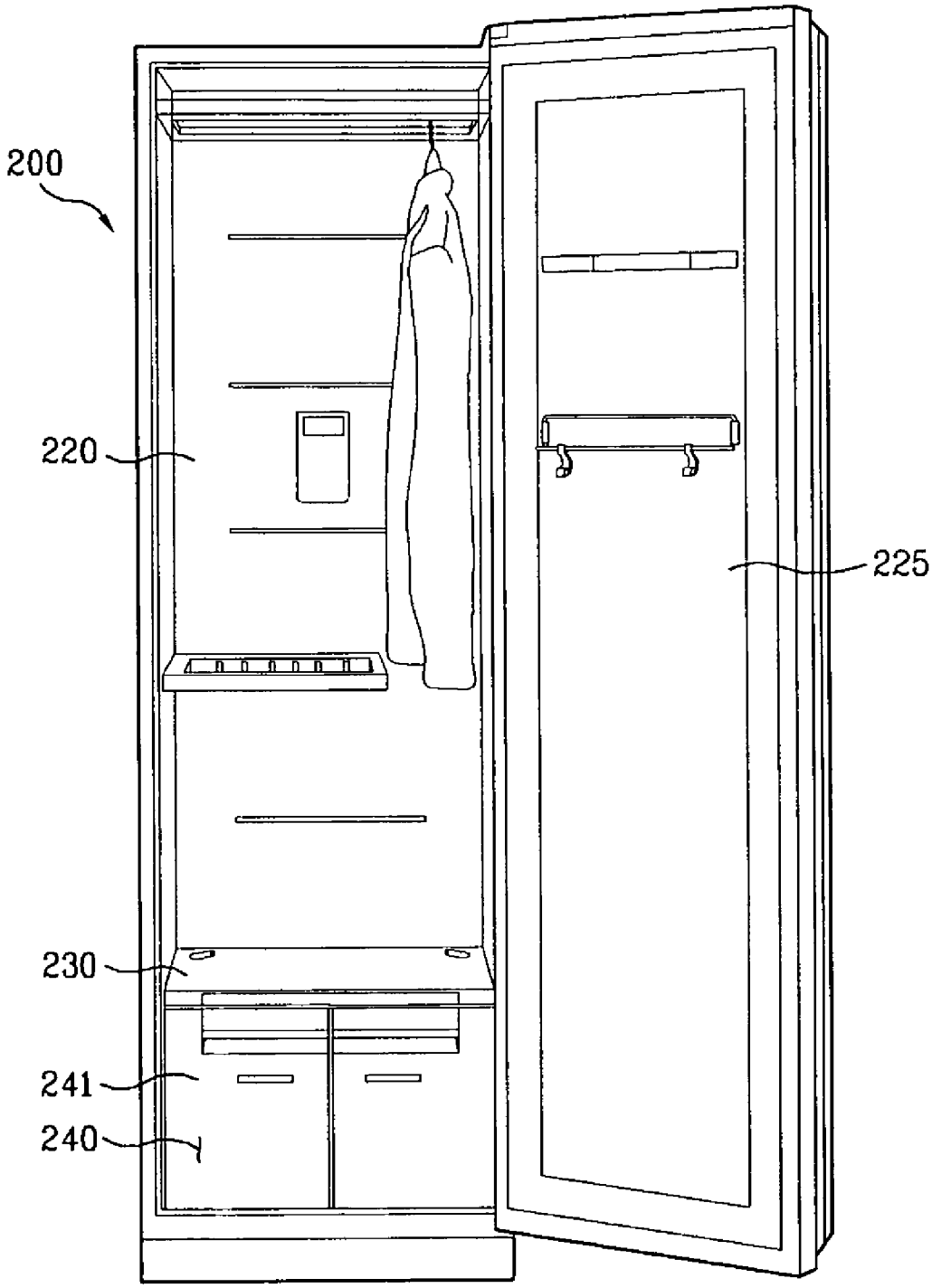
FIG. 1 is a front view diagram of a laundry machine according to the present invention.
Figure 2:
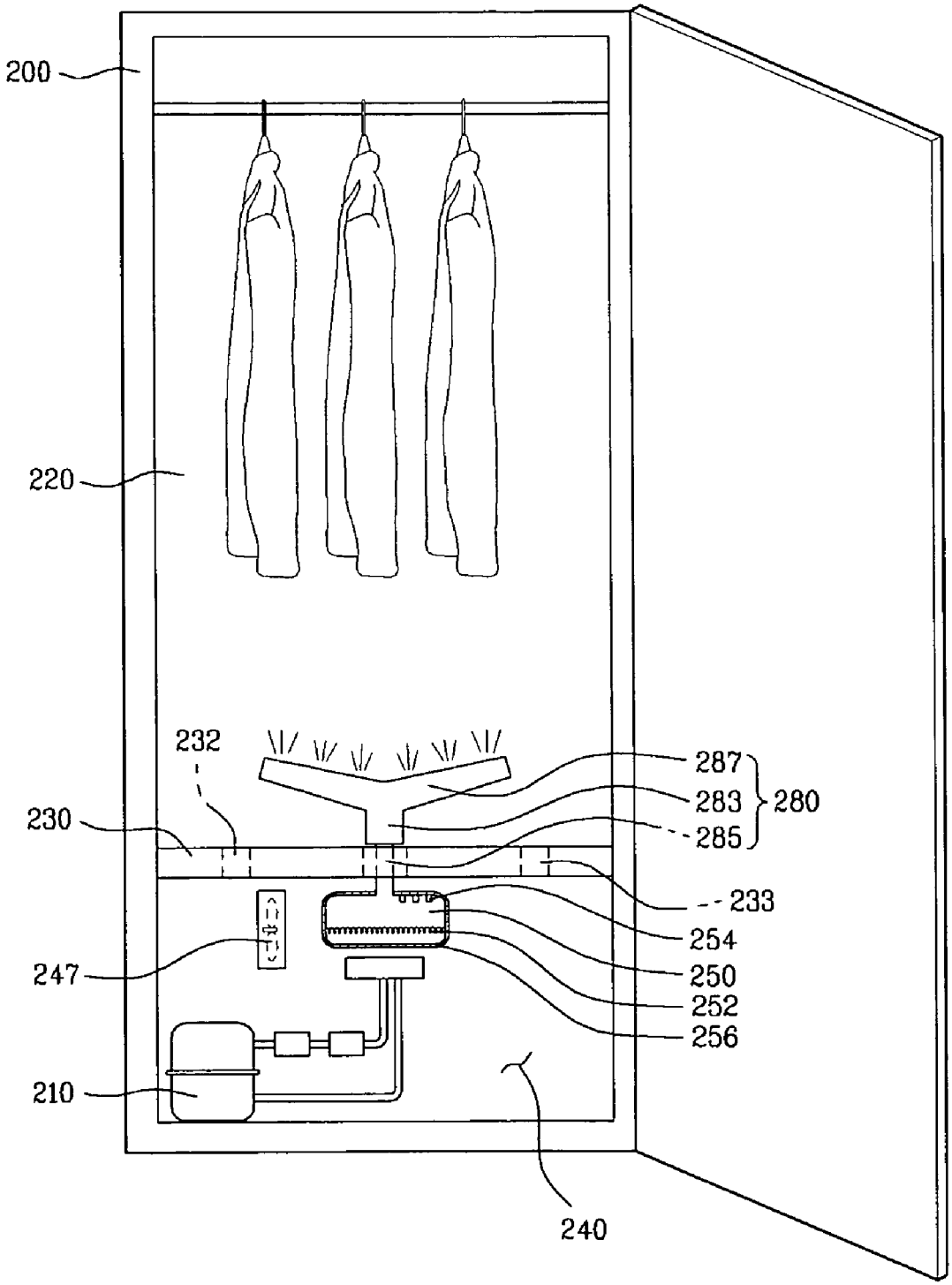
FIG. 2 is a diagram of a configuration provided within the laundry machine shown in FIG. 1.

FIG. 1 is a front view diagram of a laundry machine according to the present invention. FIG. 2 is a diagram of a configuration provided within the laundry machine shown in FIG. 1.

Referring to FIG. 1 and FIG. 2, a laundry machine according to the present invention a cabinet 200 including an accommodating space 220 for accommodating a laundry therein and a mechanism compartment 240 partitioned from the accommodating space 220 by a partition 230, a steam generator 250 configured to generate steam to be supplied to the accommodating space 220, and a steam supply unit 280 configured to pass through the partition 230, the steam supply unit 280 including a rotating nozzle 287 to supply steam into the accommodating space 220. In this case, the rotating nozzle 287 is preferably provided to rotate under the accommodating space 220.

As drawn in FIG. 1, the cabinet 200 forms an exterior of the laundry machine. An interior of the cabinet 200 is partitioned into a top side and bottom side of the cabinet 200 by the partition 230. The accommodating space 220 for accommodating the laundry is provided to the inner topside of the cabinet 200. And, the mechanism compartment 240 loaded with various devices for treating the laundry accommodated in the accommodating space 220 is provided to the inner bottom side of the cabinet 200.

A main door 225 is provided to a front side of the cabinet 200 so that a user can selectively open/close the main door 225. In particular, if the user opens the main door 225, the accommodating space 220 is externally open. The user puts a laundry in the accommodating space 220 to treat and then sets a laundry treatment to proceed.

And, a sub door 241 is provided inside the cabinet 200 so that a user can selectively open/close the sub door 241. In particular, if the user opens the sub door, the mechanism compartment is externally open. Therefore, if the user opens the main door and the sub door, the accommodating space and the mechanism compartment are externally open.

Referring to FIG. 2, the constitutions of the mechanism compartment will be described in detail.

The steam generator 250 configured to generate and supply steam to the accommodating space 220 is provided to the mechanism compartment 240. The steam generated by the steam generator 250 is supplied to the accommodating space 220 to refresh the laundry in a manner of removing the pleat of the laundry or deodorizing the laundry.

A hot air supplier 210 can be further provided to the mechanism compartment 240. In this case, the hot air supplier 210 supplies the hot air to the accommodating space 220 to dry the laundry accommodated in the accommodating space 220. Specifically, the hot air supplier 210 can perform a refresh function more effectively by algorithm interoperating with the steam generator 250.

In FIG. 2, a heat pump is used as the hot air supplier 210. In this case, the heat pump establishes a cooling cycle to generate heat. The heat is then supplied to the accommodating space 220. Alternatively, an electric heater is used to generate heat. The generated heat is then supplied to the accommodating space 220. And, various mechanisms are available for generating to supply heat to the accommodating space 220 as well.

In order to supply the hot air generated by the hot air supplier 210 to the accommodating space 220, a blower fan 247 is provided within mechanism compartment. An air inlet 232 for introducing air is provided to one side of a bottom surface of the accommodating space 220. In this case, the air inlet 232 enables the hot air supplied by the hot air supplier 210 to be introduced into the accommodating space 220 to circulate. An air outlet 233 is provided to the other side of the bottom surface of the accommodating space 220 to discharge air. And, a supply duct 245 can be provided to the mechanism compartment 240 between the air inlet 232 and the air outlet 233.

The steam generator 250 includes a housing (cf. '256' in FIG. 3) for storing water therein, a heater 252 provided within the housing 254 to generate steam by heating the water, and a level detecting sensor 254 detecting a level of water within the housing 254. Since the steam generator 250 generates the steam from the water stored therein, it can be named a container type steam generator.

Alternatively, the steam generator 250 can include a pipe type steam generator instead of the container type steam generator. In particular, the pipe type steam generator generates steam by heating water flowing in a pipe.

A direct tap water connection system, which directly connects the steam generator to a tap, is available for supplying water to the steam generator. Alternatively a cartridge system is available for the steam generator to supply water to the steam generator in a manner of supplying water to the steam generator by a pump or the like if a user provides a prescribed amount of water contained in a cartridge to the cabinet.

Figure 3:
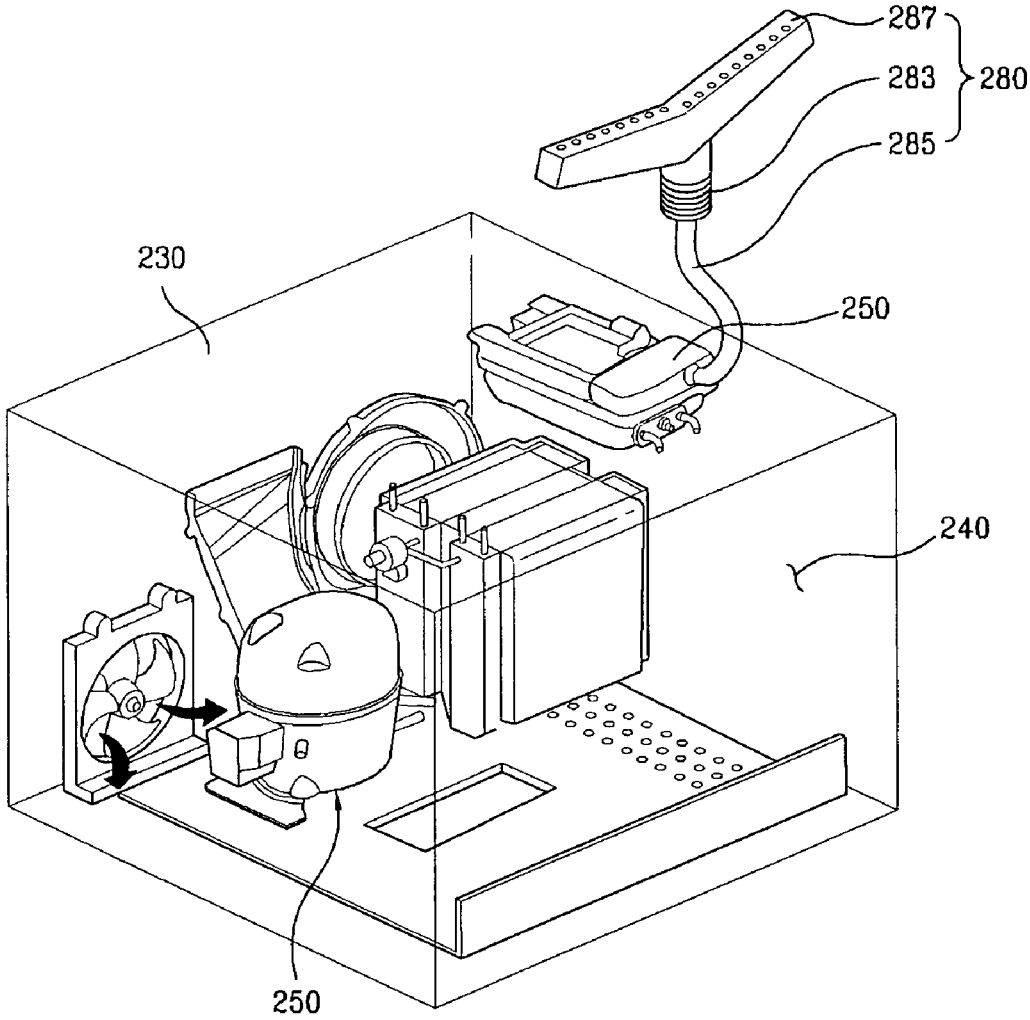
FIG. 3 is a perspective diagram of an interior of a mechanism compartment shown in FIG. 2.
Figure 4:
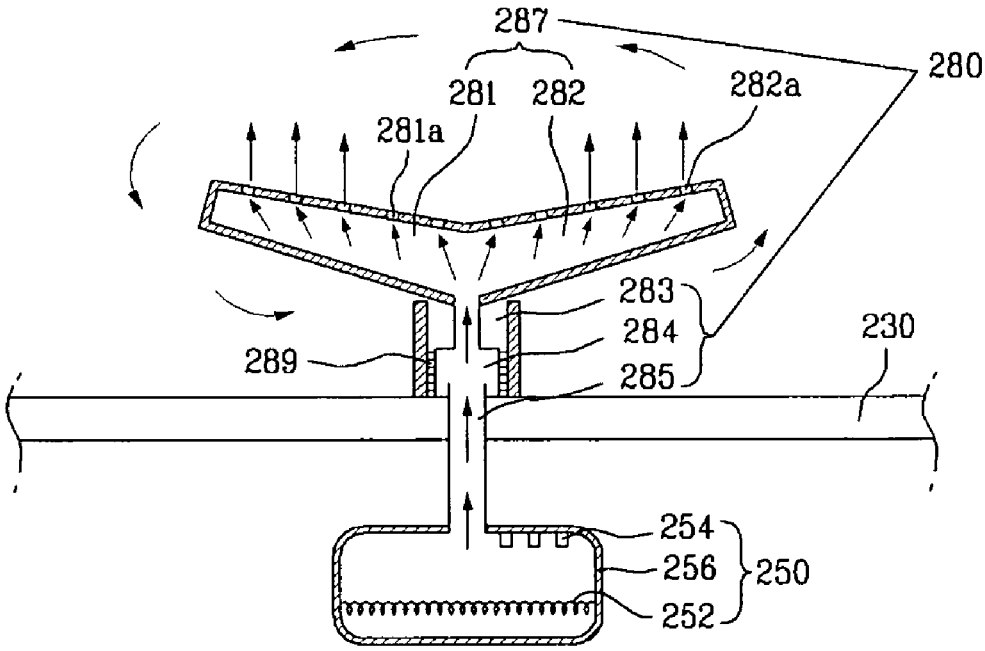
FIG. 4 is a cross-sectional diagram of a steam supply unit of a laundry machine according to one embodiment of the present invention.

Referring to FIG. 3 and FIG. 4, the steam supply unit 280 will be described in detail.

The steam supply unit 280, as shown in FIG. 3 and FIG. 4, includes a rotating nozzle 287 configured to supply the steam supplied by the steam generator 250 to the accommodating space 220. Preferably, the rotating nozzle 287 is configured to include a hollow shape.

The rotating nozzle 287 can include a plurality of sub-arms 281 and 282. Preferably, a plurality of the sub-arms 281 and 282 are provided to be symmetric to each other in a radial direction. And, each of the sub-arms 281 and 282 preferably includes a plurality of steam outlets 281*a*/282*a*.

In this case, a pair of the sub-arms can be provided in parallel with each other. Alternatively, at least three sub-arms can be provided in such a shape as a blade and the like.

A direction of the steam supplied via the steam outlets 281*a*/282*a* is mainly upward. Yet, it is preferable that the direction of the steam supplied from at least one of the steam outlets has a tangential direction component. A pressure of the steam supplied according to the tangential direction component enables the rotating nozzle 287 to be rotatable without a separate actuating device. In particular, an actuating force for rotation is generated by the tangential direction component of the supplied steam to rotate the rotating nozzle 287, as shown in FIG. 4.

Figure 5:
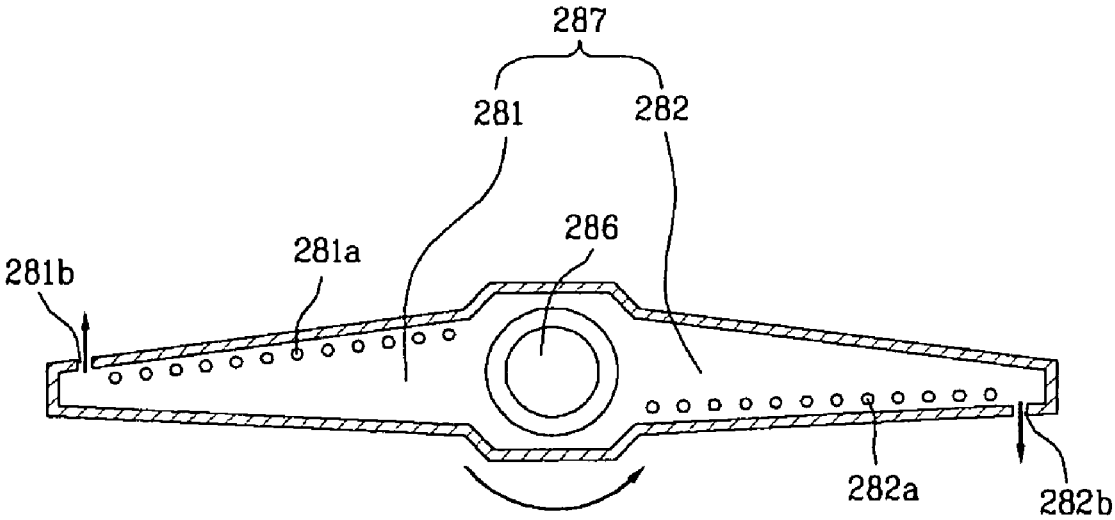
FIG. 5 is a layout of the steam supply unit shown in FIG. 3.

Meanwhile, some of the steam outlets 281*b* and 282*b* of the steam outlets 281*a* and 282*a* can be provided to lateral sides or end portions of the rotating nozzle 287 as shown in FIG. 5. The steam is supplied in a tangential direction with respect to a rotating axis of the rotating nozzle. Therefore, high rotating force can be generated by the supplying steam through the steam outlets 281*b* and 282*b*.

Preferably, the rotating nozzle 287, and more particularly, the sub-arms are configured to incline upward as they extend from a center in a radial direction. This configuration is more preferable if the rotating nozzle is located at a bottom center of the accommodating space. This is because the laundry may be mostly placed in a central area of the accommodating space. Therefore, it may be necessary to intensively supply the steam to the central area of the accommodating space. This is to prevent the steam from being supplied to a peripheral area of the accommodating space instead of the laundry.

The shapes of the sub-arms are configured to reinforce rigidity of the rotating nozzle and to enable them to be rotated by a relatively small force in a manner of reducing an inertia moment.

Alternatively, the rotating nozzle can be configured in a parabola shape which is convex upward or downward (not shown in the drawings). And, a plurality of steam outlets can be provided to the parabola portion. Optionally, a plurality of blades are provided to the parabola portion in a radial direction and a plurality of steam outlets can be provided to each of a plurality of the blades. In this case, it is preferable that at least one of the steam outlets is configured to enable a direction of the supplied steam to have a tangential direction component to a rotational direction. This is to enable the steam nozzle to be rotated by the steam pressure as well.

The steam supply unit 280 preferably includes a support shaft 283 configured to rotatably support the rotating nozzle 287. More preferably, the support shaft 283 is configured in a hollow shape.

Preferably, the steam supply unit 280 includes a steam hose 285 provided between the steam generator 250 and the support shaft 283 to form a steam path. In this case, the steam hose 285 can be connected by being inserted into the support shaft 283. To facilitate this connection, the steam hose 285 preferably includes a flexible hose. If a gap between the support shaft 283 and the steam generator 250 is constant, the flexible hose facilitates the connection in-between.

Meanwhile, the steam supply unit 280 preferably includes a rotation pipe 284 that is rotatable within the support shaft 283 in one body of the rotating nozzle 287. More preferably, the rotation pipe 284 includes a hollow type pipe.

The rotating pipe 284 is rotatably support inside the support shaft 283 through a bearing 289 and a thrust bearing can be used to support the weight of the nozzle 287. And, the steam supply unit 280 is supported to the partition 230 through the support shaft 283.

Therefore, the steam generated by the steam generator 250 flows in order of the steam hose 285, the rotation pipe 284 and the rotating nozzle 287 and is then supplied to the accommodating space 220 via the steam outlets 281*a* and 282*a*.

According to one implementation of the steam generator 280, the steam hose 285 can be configured to pass through the partition. In particular, it is able to configure the steam hose 285 to pass from the top side of the mechanism compartment 240 into the accommodating space 220. In this case, a user is facilitated to assemble/disassemble the steam hose 285 and the support shaft 283 within the accommodating space 220.

Preferably, the support shaft 283, the rotation pipe 284 and the rotating nozzle 287 can be configured as one assembly.

Therefore, the assembly or disassembly of the steam supply unit 280 for supplying the steam to the accommodating space 220 is facilitated.

Moreover, through the above-described configuration, the rotating nozzle 287 can be stably provided to the bottom of the accommodating space 220, i.e., the top side of the partition 230. Thus, as the rotating nozzle 287 is rotatably provided to the bottom of the accommodating space 220, it is able to evenly supply the steam to the laundry accommodated within the accommodating space 220.

Figure 6:
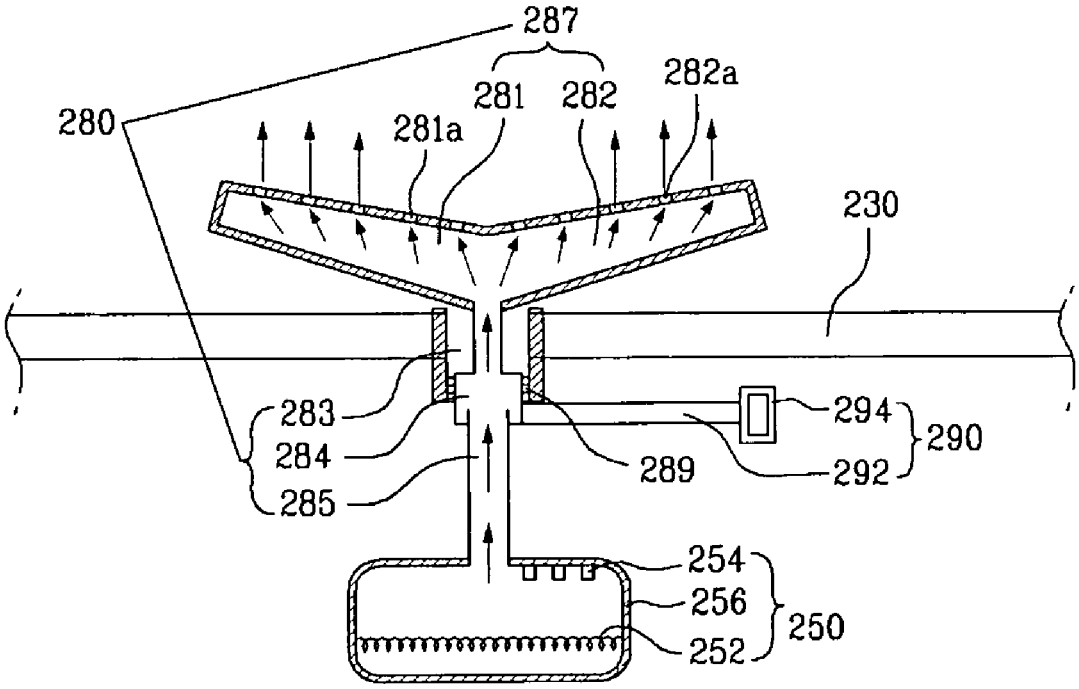
FIG. 6 is a cross-sectional diagram of a steam supply unit of a laundry machine according to another embodiment of the present invention.

FIG. 6 is a cross-sectional diagram of a steam supply unit of a laundry machine according to another embodiment of the present invention.

Referring to FIG. 6, according to another implementation of the steam supply unit 280, it is able to configure the support shaft 283 to pass through the partition 230. In particular, it is able to configure the support shaft 283 to pass from a bottom side of the accommodating space into the mechanism compartment 240.

In this case, a user is facilitated to assemble/disassemble the steam hose 285 and the support shaft 283 within the mechanism compartment 240. Preferably, the support shaft 283, the rotation pipe 284 and the rotating nozzle 287 can be configured as one assembly.

Thus, the rotating nozzle 287 is rotated by a pressure of the steam supplied from the steam generator 250. In order to raise the rotational force of the rotating nozzle 287, it is able to provide the mechanism compartment with an actuating device 290 for providing a rotational force (actuating force) to the rotation pipe 284 of the rotating nozzle 287. Optionally, it is able to provide the rotational force using the actuating device 290 only instead of the steam pressure.

The actuating device 290 includes an actuation pulley 292 connected to the rotation pipe 284 and a motor 294 connected to the actuation pulley 292 to actuate the actuation pulley 292.

Therefore, it is able to raise the rotational force of the rotating nozzle 285 by rotating the rotation pipe 284 connected to the actuation pulley 292 in a manner of activating the motor 294. Alternatively, the actuation pulley can be replaced by a gear system.

The motor can include a BLDC (brushless DC) motor, an inverter motor or the like to facilitate the control of a rotational speed and a rotational direction of the rotating nozzle if necessary.

Regarding the above-described two types of the steam supply unit 280, the former is more effective than the latter in facilitation of the assembly/disassembly. This is because the assembly/disassembly can be performed in the accommodating space that is relatively spacious and free from obstacles. On the contrary, in aspect of the stable support of the steam supply unit 280 and the space utilization of the accommodating space, the latter may be more effective than the former. This is because an overall height of the steam supply unit 280 can be lowered.

Therefore, it is ale to consider a combination of the two types of the steam supply unit 280. In particular, the steam hose 285 and the support shaft 286 are partially inserted in the partition 230 so that the steam hose 285 and the support shaft 286 can be connected together within the partition 230.

Meanwhile, the laundry machine according to embodiments of the present invention preferably includes a main door 225 and a sub-door 241.

The sub-door 241 is provided to a front side of the mechanism compartment to enable the mechanism compartment to be selectively opened/closed.

In this case, the sub-door 241 is provided internally behind the main door 225. Hence, the main door 225 should be first opened to open the sub-door 241. Thus, a dual door structure including the main door 225 and the sub-door is preferably provided.

If a fine view and safety are taken into consideration, it is preferable that an interior of the mechanism compartment is not externally exposed while the main door is normally open.

Preferably, the above-described laundry machine according to the embodiments of the present invention further includes a main door for selectively opening or closing the accommodating space. Moreover, the laundry machine according to the embodiments of the present invention further includes a sub-door for selectively opening or closing the mechanism compartment when the main door is open. This is because, when the main door is normally open, the mechanism compartment is preferably closed for a fine view and safety.

Moreover, a dual-door structure including the main door and the sub-door is provided to facilitate the assembly/disassembly of the steam generator and the steam supply unit. This is because, while both of the main door and the sub-door are open, a user is able to secure a view and space with ease. Therefore, the user is facilitated to assemble/disassemble the steam supply unit configured to pass through the partition and the steam generator provided to the mechanism compartment.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a cabinet comprising a space configured to statically accommodate laundry and a mechanism compartment partitioned from the space by a partition;

a steam generator provided in the mechanism compartment to generate steam to be supplied to the space;

a steam supply unit provided in the cabinet to pass through the partition, the steam supply unit comprising:

a rotating nozzle to supply steam into the space;

a support shaft configured to rotatably support the nozzle, wherein the support shaft includes a hollow pipe; and a steam hose configured to connect the nozzle to the steam generator, wherein the steam hose is configured to pass through the partition.

2. The laundry machine of claim 1, wherein the nozzle comprises a plurality of sub-arms.

3. The laundry machine of claim 2, wherein the each sub arm comprises a plurality of steam outlets.

4. The laundry machine of claim 3, wherein at least one of the steam outlets is provided to supply the steam in a tangential direction with respect to a rotating axis of the nozzle so as to rotate the nozzle.

5. The laundry machine of claim 4, wherein the sub-arms are upwardly slanted in a radial direction.

6. The laundry machine of claim 1, wherein the steam hose connected to the support shaft by being inserted into the support shaft.

7. The laundry machine of claim 6, wherein the steam hose is formed as a flexible hose.

8. The laundry machine of claim 1, wherein the support shaft is configured to pass through the partition.

9. The laundry machine of claim 1, wherein the steam supply unit further comprises a rotation pipe configured to rotate inside the support shaft as one body with the nozzle.

10. The laundry machine of claim 9, further comprising an actuating device configured to generate actuating force to rotate the rotation pipe, the actuating device being installed in the mechanism compartment.

11. The laundry machine of claim 9, further comprising:

a main door for selectively opening or closing the space; and a sub-door provided inside the cabinet for selectively opening or closing the mechanism compartment when the main door is open.

12. The laundry machine of claim 11, wherein the steam supply unit further comprises a flexible steam hose configured to form a steam path between the steam generator and the support shaft.

13. The laundry machine of claim 12, wherein the steam supply unit further comprises a rotation pipe configured to rotate inside the support shaft as one body with the nozzle.

14. The laundry machine of claim 13, wherein the steam hose is configured to pass through the partition and to be connected to the support shaft in the space.

15. The laundry machine of claim 13, wherein the support shaft is configured to pass through the partition and to be connected to the steam hose in the mechanism compartment.

16. The laundry machine of claim 13, wherein the nozzle has a parabola shape portion, a plurality of steam outlets being formed at the parabola shape portion.

* * * * *